US006525596B2

(12) United States Patent
Hosono et al.

(10) Patent No.: US 6,525,596 B2
(45) Date of Patent: Feb. 25, 2003

(54) SERIES REGULATOR HAVING A POWER SUPPLY CIRCUIT ALLOWING LOW VOLTAGE OPERATION

(75) Inventors: Rinya Hosono, Tsurugashima (JP); Takeyuki Kouchi, Tsurugashima (JP); Yukinori Kiya, Tsurugashima (JP); Takashi Sogabe, Tsurugashima (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 09/840,379

(22) Filed: Apr. 23, 2001

(65) Prior Publication Data

US 2001/0022527 A1 Sep. 20, 2001

Related U.S. Application Data

(63) Continuation of application No. PCT/JP00/05627, filed on Aug. 23, 2000.

(30) Foreign Application Priority Data

Sep. 13, 1999 (JP) ..... 11-258567

(51) Int. Cl.[7] ..... G05F 1/10

(52) U.S. Cl. ..... 327/540; 327/543; 323/316

(58) Field of Search ..... 327/538, 540, 327/541, 543; 323/313, 315, 316

(56) References Cited

U.S. PATENT DOCUMENTS

| | | | | |
|---|---|---|---|---|
| 4,636,710 A | * | 1/1987 | Stanojevic | 323/280 |
| 4,906,863 A | * | 3/1990 | Van Tran | 323/313 |
| 5,049,806 A | * | 9/1991 | Urakawa et al. | 323/314 |
| 5,289,111 A | * | 2/1994 | Tsuji | 323/313 |
| 5,512,817 A | * | 4/1996 | Nagaraj | 323/316 |
| 5,929,617 A | * | 7/1999 | Brokaw | 323/280 |
| 6,002,293 A | * | 12/1999 | Brokaw | 323/313 |
| 6,097,180 A | * | 8/2000 | Tsukude et al. | 323/313 |
| 6,225,857 B1 | * | 5/2001 | Brokaw | 327/540 |

FOREIGN PATENT DOCUMENTS

| | | |
|---|---|---|
| JP | 1-151315 | 10/1989 |
| JP | 3-104211 | 10/1991 |
| JP | 6-75017 | 10/1994 |
| JP | 9-54625 | 2/1997 |

* cited by examiner

*Primary Examiner*—Terry D. Cunningham
(74) *Attorney, Agent, or Firm*—Cohen, Pontani, Lieberman & Pavane

(57) ABSTRACT

There is disclosed a semiconductor device, which allows the ripple rejection characteristics to be improved and the operating voltage to be reduced. The semiconductor device comprises a power supply circuit arranged between an input terminal and internal circuits so as to make a connection therebetween, said power supply circuit including a transistor $Q_{41}$ for supplying each of the internal circuits with a drive voltage and another transistor $Q_{44}$ for allowing a current to pass therethrough in response to a magnitude of a reference voltage supplied to a base thereof and a magnitude of the drive voltage supplied to an emitter thereof. A part of the circuit composed of transistors $Q_{42}$, $Q_{43}$ and a resistor $R_5$ controls a current flowing through of the transistor $Q_{41}$ based on the current that has passed though the transistor $Q_{44}$, so that the drive voltage could be set to a value higher than the reference voltage approximately by a magnitude of a forward voltage between the base and the emitter of the transistor $Q_{44}$.

2 Claims, 2 Drawing Sheets

SERIES REGULATOR HAVING A POWER SUPPLY CIRCUIT ALLOWING LOW VOLTAGE OPERATION

FIELD OF THE INVENTION

This application is a Continuation patent application of International Application No. PCT/JP00/05627 (not published in English), filed on Aug. 23, 2000.

DESCRIPTION OF THE PRIOR ART

A typical semiconductor device formed into ICs has internally a large number of basic functional circuits, such as amplifier circuits, comparator circuits, and/or reference voltage generator circuits, with high integration density. An example of such semiconductor device is a regulator IC comprising an internal circuit with a configuration shown in the circuit diagram of FIG. 2.

Referring to the circuitry of FIG. 2, a main current path of a transistor $Q_1$ of PNP type is connected in series between an input terminal 1 and an output terminal 2, and a base of the transistor $Q_1$, is connected to a ground via a main current path of a transistor $Q_2$ of PNP type. A resistor $R_{13}$ is arranged between the base and an emitter of the transistor $Q_1$ and resistors $R_1$ and $R_2$ are arranged as connected in series between the output terminal 2 and a ground. There are also configured a power supply circuit 4*b*, a reference voltage generator circuit 5, and an error amplifier circuit 6, in which the power supply circuit 4*b* is arranged between the input terminal 1 and a power supply terminal for the reference voltage generator circuit 5 and the error amplifier circuit 6 to connect them together. One of the input terminals of the error amplifier circuit 6 is connected to an output terminal of the reference voltage generator circuit 5, while the other input terminal of the error amplifier circuit 6 is connected to a junction point of the resistor $R_1$ and the resistor $R_2$, and an output terminal of the error amplifier circuit 6 is connected to a base of the transistor $Q_2$.

Herein, the power supply circuit 4*b*, the reference voltage generator circuit 5 and the error amplifier circuit 6 are respectively configured as described below.

An emitter of a transistor $Q_{41}$ of PNP type is connected to the input terminal 1, and a collector thereof is connected via a resistor $R_8$ and a diode $D_{43}$ to a ground. A resistor $R_8$ is arranged between a base of the transistor $Q_{41}$ and the input terminal 1, a main current path of a transistor $Q_{42}$ of NPN type is arranged between the base of the transistor $Q_{41}$ and a ground, and a diode $D_{41}$ is arranged between the base and the collector of the transistor $Q_{41}$. A base of the transistor $Q_{42}$ is connected via a resistor $R_4$ to a control input terminal 3, thus to configure the power supply circuit 4*b*.

Further, to the collector of the transistor $Q_{41}$, which is a component of the power supply circuit 4*b*, are connected the respective emitters of transistors $Q_{51}$ and $Q_{52}$, each being of PNP type. Respective bases of the transistors $Q_{51}$ and $Q_{52}$ are connected with each other, and a collector and the base of the transistor $Q_{51}$ are interconnected. Each collector of the transistors $Q_{51}$ and $Q_{52}$ is respectively connected to each collector of NPN type transistor $Q_{53}$ or $Q_{54}$. Respective bases of the transistors $Q_{53}$ and $Q_{54}$ are connected with each other, and the collector and the base of the transistor $Q_{54}$ are interconnected. An emitter of the transistor $Q_{53}$ is connected via a series circuit composed of resistors $R_{10}$ and $R_{11}$ to a ground, and an emitter of the transistor $Q_{54}$ is connected to a junction point of the resistors $R_{10}$ and $R_{11}$. A main current path of a transistor $Q_{55}$ whose base is in connection with a junction point of the resistor $R_8$ and the diode $D_{43}$ of the power supply circuit 4*b* is arranged as connected in parallel with a main current path of the transistor $Q_{53}$, thus to configure the reference voltage generator circuit 5.

Then, each of emitters of PNP type transistors $Q_{61}$ and $Q_{62}$ is connected to the collector of the transistor $Q_{41}$, which is a component of the power supply circuit 4*b*. Respective bases of the transistors $Q_{61}$ and $Q_{62}$ are connected with each other, and a collector and the base of the transistor $Q_{62}$ are interconnected. Each of collectors of the transistors $Q_{61}$ and $Q_{62}$ is respectively connected to each collector of NPN type transistor $Q_{63}$ or $Q_{64}$. Respective emitters of the transistors $Q_{63}$ and $Q_{64}$ are connected with each other, and a resistor $R_{12}$ is arranged between a common junction point of the respective emitters and a ground. A base of the transistor $Q_{63}$ is connected to the collector and the base of the transistor $Q_{54}$ which is a component of the reference voltage generator circuit 5, and a base of the transistor $Q_{64}$ is connected to a junction point of the resistors $R_1$ and $R_2$. A junction point of the collectors of the transistors $Q_{61}$ and $Q_{63}$ is connected to the base of the transistor $Q_2$, thus to configure the error amplifier circuit 6.

In the circuitry of FIG. 2, which has been configured as described above, an increased level of a control signal applied to the control input terminal 3 turns on the transistors $Q_{42}$ and $Q_{41}$. Thereby, a drive voltage from an external power source connected to the input terminal 1 is supplied via the transistor $Q_{41}$ of the power supply circuit 4*b* to each of the internal circuitries of the reference voltage generator circuit 5 and the error amplifier circuit 6.

In the reference voltage generator circuit 5 supplied with the drive voltage, upon starting the circuit, at first the transistor $Q_{55}$ is turned on, and a current mirror circuit composed of the transistors $Q_{51}$ and $Q_{52}$ is made operative. Secondarily, another current mirror circuit composed of the transistors $Q_{53}$ and $Q_{54}$ is made operative, which has been supplied with the current from the transistors $Q_{51}$ and $Q_{52}$, and in turn the transistor $Q_{55}$ is turned off as the transistor $Q_{53}$ is turned on. After that, the activated reference voltage generator circuit 5 would generate a reference voltage of about 1.25V, based on a band gap of the semiconductor material, at the positions of collector and the base of the transistor $Q_{54}$.

On the other hand, in the error amplifier circuit 6, which has been supplied with the drive voltage, at first the transistor $Q_{63}$ supplied with the reference voltage conducts, and thereby the transistors $Q_2$ and $Q_1$ conduct. As the transistor $Q_1$ has conducted, an electric power from the input terminal 1 is transmitted via the transistor $Q_1$ to the output terminal 2, and thus an output voltage is generated on the output terminal 2. The output voltage generated on the output terminal 2 is divided by the resistors $R_1$ and $R_2$, which in turn is supplied to the base of the transistor $Q_{64}$. Subsequently, the transistor $Q_{64}$ conducts to make operative the current mirror circuit composed of the transistors $Q_{61}$ and $Q_{62}$. After that, the activated error amplifier circuit 6 would control the current flowing through the transistors $Q_2$ and $Q_1$ in response to the reference voltage supplied to the transistor $Q_{63}$ and the divided voltage supplied to the transistor $Q_{64}$ so as to regulate the magnitude of the output voltage to be constant.

In such a circuitry as shown in FIG. 2, the reference voltage generator circuit 5 and the error amplifier circuit 6 are connected via the transistor $Q_{41}$ in on-state and the input terminal 1 to the external power source. Owing to this configuration, if a voltage supplied from the external power source fluctuates, the reference voltage generator circuit 5 and the error amplifier circuit 6 would be subject to a direct effect of the voltage fluctuation. In addition, there has been a problem that each of the transistors $Q_{51}$, $Q_{52}$, $Q_{61}$ and $Q_{62}$, each being of PNP type, arranged in the power source side of each of the circuits 5 and 6 tends to suffer from the Early effect seriously when a high voltage is applied, or that the transistors of PNP type are subject to the effects of variations in various conditions in the manufacturing processes, resulting in the characteristic value of each product to be varied widely.

Because of these reasons mentioned above, the circuitry employing the configuration of FIG. 2 is especially subject to the effect of the voltage fluctuation, which has made it difficult to improve and homogenize the ripple rejection characteristics against the fluctuation in the input voltage to the semiconductor device.

For such a circuitry as shown in FIG. 2, an attempt has been made to improve the characteristics by designing the power supply circuit with a configuration as shown in FIG. 3.

Referring to the circuitry of FIG. 3, each of emitters of PNP type transistors $Q_{48}$ and $Q_{49}$ is connected to the input terminal 1. Respective bases of the transistors $Q_{48}$ and $Q_{49}$ are connected with each other, and a collector and the base of the transistor $Q_{48}$ are interconnected. A resistor $R_9$ and a main current path of a transistor $Q_{42}$ are arranged between the collector of the transistor $Q_{48}$ and a ground to be connected in series, and a base of the transistor $Q_{42}$ is connected via a resistor $R_4$ to the control input terminal 3. A collector of the transistor $Q_{49}$ is connected to a base of a NPN type transistor $Q_{410}$, and a plurality of diodes $D_{44}$–$D_{48}$ is arranged between the collector of the transistor $Q_{49}$ and a ground to be connected in series. Then, a collector of the transistor $Q_{410}$ is connected to the reference voltage generator circuit 5 and the error amplifier circuit 6, and a power supply circuit 4*c* has been thus configured.

In the power supply circuit 4*c* configured as described above, an increased level of control signal applied to the control input terminal 3 brings the transistor $Q_{42}$ into on-state so as to activate a current mirror circuit composed of the transistors $Q_{48}$ and $Q_{49}$. A part of the current passed through the main current path of the transistor $Q_{49}$ flows via the serially connected diodes $D_{44}$–$D_{48}$ into the ground, while the potential at a point of the base of the transistor $Q_{410}$ is raised up by a forward voltage generated in the diodes $D_{44}$–$D_{48}$. Subsequently, the transistor $Q_{410}$ operates so that a combined value of a voltage at a point of the emitter thereof and a voltage between the base and the emitter thereof is made equal to a voltage at a point of the base thereof, and thus a drive voltage to be supplied to the reference voltage generator circuit 5 and the error amplifier circuit 6 is made almost equal to a magnitude determined by subtracting the voltage between the base and the emitter of the transistor $Q_{410}$ from the total of forward drop voltages generated in the diodes $D_{44}$–$D_{48}$. Thereby, even if the input voltage would fluctuate, the fluctuation in the drive voltage could be controlled so as to be smaller than that in the input voltage, so that the ripple rejection characteristics of the semiconductor device against the fluctuation in the input voltage could be improved and homogenized.

It should be noted that, when a reference voltage generator circuit of band gap type similar to that shown in FIG. 2 is employed as a reference voltage generator circuit 5 of FIG. 3, a drive voltage to be supplied to the reference voltage generator circuit 5 is required to have a voltage value of approximately equal to or more than 1.8V. In the circuitry with the configuration shown in FIG. 3, this drive voltage is determined by the total of the forward voltage drops of the diodes $D_{44}$–$D_{48}$.

A magnitude of the forward voltage drop of a diode element is about 0.7V per one element at ambient temperature of about 20° C. To make the drive voltage be 1.8V or more, with a voltage between the base and the emitter of the transistor $Q_{410}$ taken into account, four pieces of diode elements are needed. However, since a diode element has a temperature characteristic of about −2 mV/° C., another piece of diode must be added to make the drive voltage not to drop under 1.8V over the range of operating temperature of the semiconductor device. Accordingly, the power supply circuit 4*c* shown in FIG. 3 should have the total of five or more diode elements connected in series.

In such a case, a voltage to be supplied from the external power source to the semiconductor device is required to have a voltage value equal to or more than 3.5V, which is equivalent to the total of the forward voltage drops of the diodes $D_{44}$–$D_{48}$ added with the voltage between the collector and the emitter of the transistor $Q_{49}$. However, the current market requires a semiconductor device to have a minimum operating voltage value of 2.5V, which has not been achieved by the semiconductor device employing the power supply circuit 4*c* of FIG. 3 which requires to have a voltage value equal to or more than 3.5V.

Accordingly, an object of the present invention is to improve the ripple rejection characteristics and to reduce the operating voltage of a semiconductor device.

SUMMERY OF THE INVENTION

Above object can be accomplished by the present invention which provides a semiconductor device comprising: an input terminal connected to an external power source; an internal circuit including a reference voltage generator circuit; and further a power supply circuit located between said input terminal and said internal circuit so as to make a connection therebetween, said power supply circuit having a first transistor for supplying said internal circuit with a drive voltage and a second transistor for passing a current therethrough in response to a magnitude of a reference voltage outputted from said reference voltage generator circuit and a magnitude of said drive voltage, wherein said drive voltage is lower than the voltage supplied to said input terminal but is higher than the reference voltage outputted from said reference voltage generator circuit.

DESCRIPTION OF THE PREFERRED EMBODIMENTS

A power supply circuit is introduced into a semiconductor device between an input terminal and an internal circuit including a reference voltage generator circuit so as to be connected therewith.

The power supply circuit comprises; a first transistor whose main current path is arranged between the input terminal and the internal circuit for supplying a drive voltage to the internal circuit; and a second transistor for allowing a current to pass therethrough, in response to a magnitude of the reference voltage supplied to a control terminal from the reference voltage generator circuit and a magnitude of the drive voltage supplied to one end of the main current path. In response to the current passed though the second transistor, a current flowing through the first transistor is controlled so as to set the drive voltage to be lower than the voltage applied to the input terminal but to be higher than the reference voltage outputted from the reference voltage generator circuit. In specific, the drive voltage is set to a value higher than the reference voltage by the amount of forward voltage of a semiconductor element, which is to be the second transistor.

Figure 1:
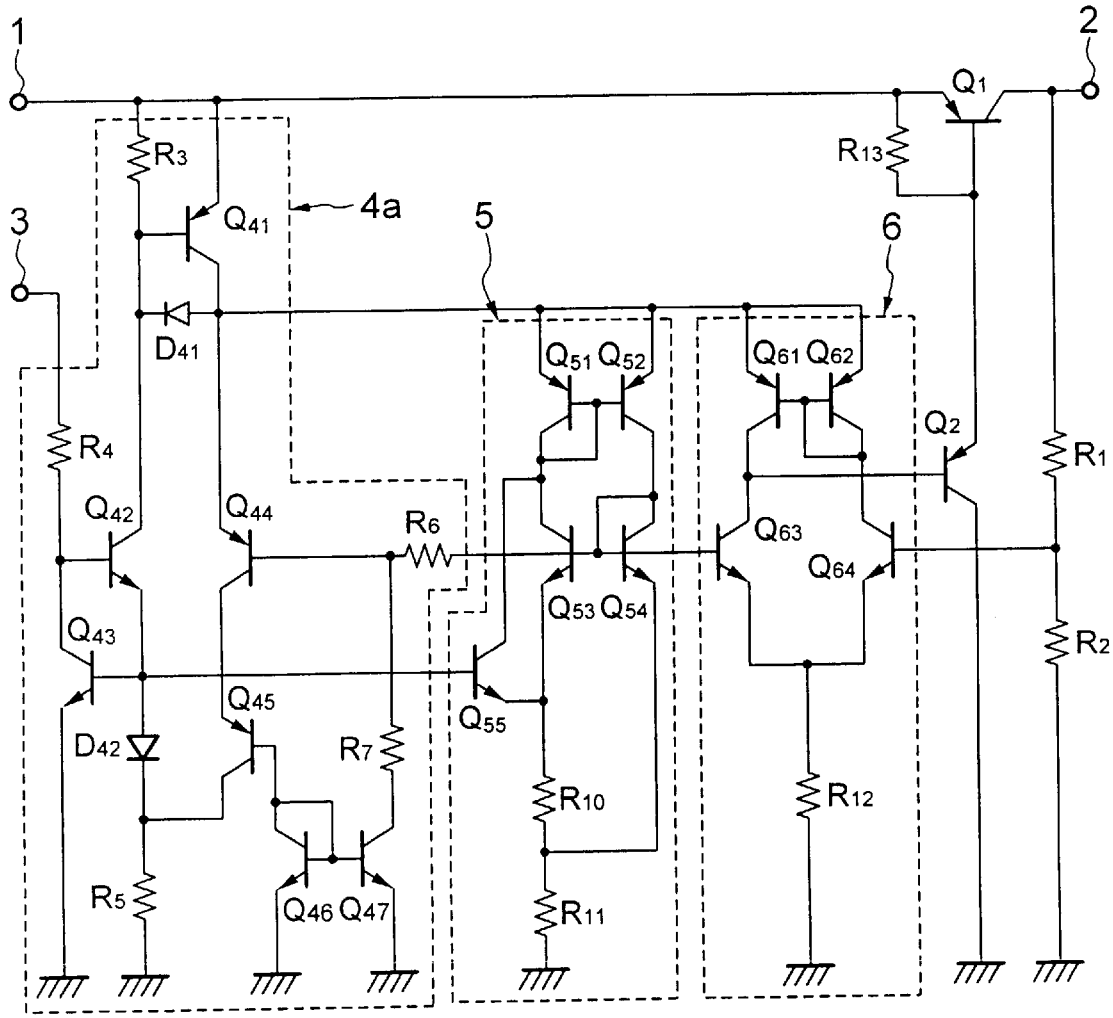
FIG. 1 is a circuit diagram of a semiconductor device of an embodiment according to the present invention.

FIG. 1 shows a circuit diagram of a semiconductor device according to an embodiment of the present invention, which can improve the ripple rejection characteristics and reduce an operating voltage. The circuit shown in FIG. 1 comprises a power supply circuit 4*a*, which is configured as described below. It is to be noted that in FIG. 1 the same reference numerals designates the components similar to those shown in FIGS. 2 and 3.

An emitter of a transistor $Q_{41}$ is connected to an input terminal 1, and a resistor $R_3$ and a diode $D_{41}$ are respectively arranged between a base and the emitter and between a collector and the base of the transistor $Q_{41}$. The base of the transistor $Q_{41}$ is connected to a collector of a transistor $Q_{42}$, and an emitter of the transistor $Q_{42}$ is connected to a ground via a series circuit composed of a diode $D_{42}$ and a resistor $R_5$. A base of the transistor $Q_{42}$ is connected to a control input terminal 3 via a resistor $R_4$ and further the base of the transistor $Q_{42}$ is connected to a collector of a transistor $Q_{43}$ of NPN type. A base of the transistor $Q_{43}$ is connected to the emitter of the transistor $Q_{42}$, and an emitter of the transistor $Q_{43}$ is connected to a ground.

The collector of the transistor $Q_{41}$ is connected to an emitter of a transistor $Q_{44}$ of PNP type, a collector of the transistor $Q_{44}$ is connected to an emitter of a transistor $Q_{45}$ of PNP type, and a collector of the transistor $Q_{45}$ is connected to a junction point of the diode $D_{42}$ and the resistor $R_5$. Respective bases of two NPN type transistors $Q_{46}$ and $Q_{47}$ are connected with each other, and emitters thereof are connected respectively to grounds. A collector and the base of the transistor $Q_{46}$ is connected to each other and the collector of the transistor $Q_{46}$ is connected to a base of the transistor $Q_{45}$. A collector of the transistor $Q_{47}$ is connected via a resistor $R_7$ to a base of the transistor $Q_{44}$, and the base of the transistor $Q_{44}$ is connected via a resistor $R_6$ to a circuit point of a reference voltage generator circuit 5 where a reference voltage is obtained, thus to configure the power supply circuit 4*a*.

Figure 2:
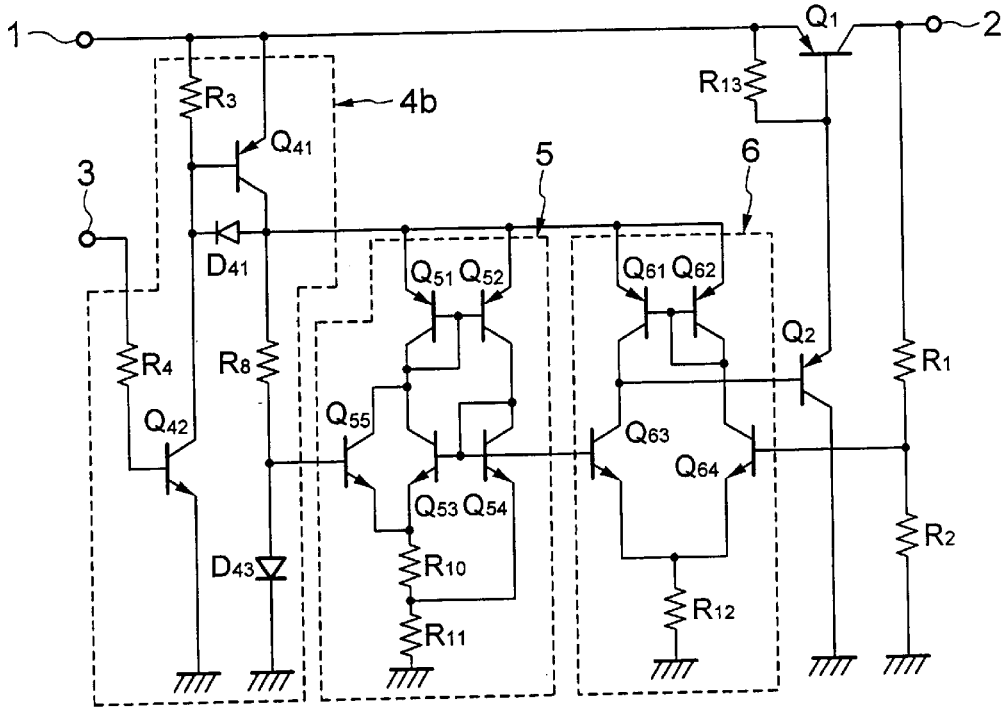
FIG.2 (PRIOR ART)
FIG. 2 is an exemplary circuit diagram of a conventional semiconductor device.
Figure 3:
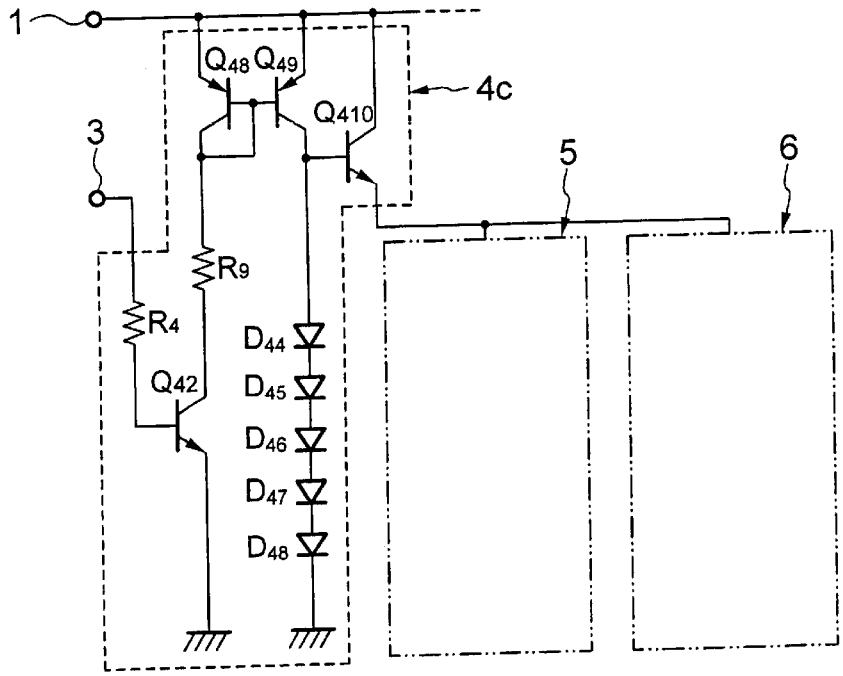
FIG.3 (PRIOR ART)
FIG. 3 is another circuit diagram of a conventional semiconductor device with improved characteristics.

It should be noted that the rest of the circuitry of FIGS. 1 and 2 is the same with the circuitry of FIG. 2, except that in FIG. 1 a base of a transistor $Q_{55}$ for activating the reference voltage generator circuit 5 is connected to the emitter of the transistor $Q_{42}$.

In the circuit of the configuration as shown in FIG. 1, the power supply circuit 4*a* supplies the reference voltage generator circuit 5 and an error amplifier circuit 6 with a drive voltage in a manner as described below.

As a level of a control signal applied to the control input terminal 3 are getting higher, the transistor $Q_{41}$ together with the transistor $Q_{42}$ conducts to supply the drive voltage from the power supply circuit 4*a* to the respective internal circuits of the reference voltage generator circuit 5 and the error amplifier circuit 6. Herein, the transistor $Q_{48}$ serves so as to stabilize a base current of the transistor $Q_{42}$ in response to a voltage generated on the series circuit composed of the diode $D_{42}$ and the resistor $R_5$. Owing to the fact that the transistor $Q_{55}$ conducts immediately after the transistor $Q_{42}$ has conducted, the reference voltage generator circuit 5 starts to operate so as to generate a reference voltage of about 1.25V at the points of base and collector of the transistor $Q_{54}$. This reference voltage is supplied to the error amplifier circuit 6, and at the same time, is also supplied via the resistor $R_6$ to the base of the transistor $Q_{44}$ of the power supply circuit 4*a*.

Herein, when the drive voltage generated on the point of collector of the transistor $Q_{41}$ is to get higher than the predetermined voltage value, a current flow from the collector of the transistor $Q_{44}$ via the main current path of the transistor $Q_{45}$ into the resistor $R_5$ is increased. This raises a voltage between the terminals of the resistor $R_6$ and thereby the flow rate of the base current of the transistor $Q_{41}$ flowing through the transistor $Q_{42}$ is reduced. As a result, the voltage between the collector and the emitter of the transistor $Q_{41}$ is increased and thereby the drive voltage is controlled so as not to exceed said predetermined voltage value. It should be appreciated that the predetermined voltage value designated in the circuit of the configuration shown in FIG. 1 is almost equal to a total voltage value of the reference voltage supplied to the base of the transistor $Q_{44}$ added with the forward voltage between the base and the emitter of the transistor $Q_{44}$.

Since in the configuration of FIG. 1 the reference voltage is 1.25V and the forward voltage between the base and the emitter of the transistor $Q_{44}$ is approximately 0.65V, the drive voltage supplied to the reference voltage generator circuit 5 is to be set to a value of about 1.9V by the power supply circuit 4*a*. Even if the voltage supplied from an external power source fluctuates, the operation of said power supply circuit 4*a* for setting the drive voltage as described above can significantly reduce the effect of the fluctuation on the voltage supplied to the reference voltage generator circuit 5 and the error amplifier circuit 6. Accordingly it is turned out that the apparent ripple rejection characteristics of each circuit within a semiconductor device could be improved. In addition, with the drive voltage of 1.9V and the voltage between the collector and the emitter of the transistor $Q_{41}$ taking into account, the semiconductor device employing the circuit configuration shown in FIG. 1 can reduce a minimum operating voltage to about 2V, thus to accomplish the voltage reduction in the operating voltage.

It should be noted that a current mirror circuit composed of the transistors $Q_{46}$ and $Q_{47}$ serves to correct the base currents of the transistors $Q_{44}$ and $Q_{45}$. Further, in this operation, the transistor $Q_{41}$ shown in FIG. 1 has a function as a switch for turning on/off the drive voltage to be supplied to an internal circuit, such as the reference voltage generator circuit 5, in response to a level of a control signal applied to the control input terminal 3, as well as a function as a voltage control element for stabilizing the drive voltage. Furthermore, the part of circuit composed of the transistors $Q_{42}$ and $Q_{43}$ and the resistor $R_5$ has a function as a constant current circuit for providing a stable base current of the transistor $Q_{41}$ as well as a function as a control circuit for controlling the base current of the transistor $Q_{41}$ in response to a current signal entered from the transistor $Q_{44}$.

Although in the embodiment of the present invention described above, the circuit diagram shown in FIG. 1 represents a configuration of series regulator as a whole, the present invention is not limited to this application but is applicable to other various semiconductors equipped with an internal circuit including a reference voltage generator circuit.

Further, although the embodiment of FIG. 1 shows a semiconductor device with a configuration which comprises the control input terminal 3 and allows the operation thereof to be externally turned on/off, the semiconductor may have a configuration in which, for example, one end of the resistor $R_4$ is not connected to the control input terminal 3 but is connected to the input terminal 1 so as to prohibit the operation from being externally turned on/off.

Still further, various modifications may be applied to the circuit configuration without departing from the spirit and scope of the present invention, including that the diode $D_{42}$ in the power supply circuit 4*a* may be omitted, and/or that the reference voltage generator circuit 5 may be designed with other configuration.

As having been described above, a semiconductor device according to the present invention comprises a power supply circuit introduced between an input terminal and an internal circuit so as to be connected therewith, said power supply circuit including a first transistor for supplying the internal circuit with a drive voltage and a second transistor for allowing a current to pass therethrough in response to a magnitude of a reference voltage outputted from a reference voltage generator circuit and a magnitude of the drive voltage. Herein, the power supply circuit is characterized in that it controls a current flowing through the first transistor based on the current passed through the second transistor so that the drive voltage could have a magnitude higher than the reference voltage outputted from the reference voltage generator circuit by a magnitude of a forward voltage of a semiconductor element.

Thereby, the operation of the power supply circuit for setting the drive voltage can significantly reduce the effect of the fluctuation in the supply voltage on the internal circuitry thus to improve the ripple rejection characteristics of the semiconductor device. Further, owing to the fact that the drive voltage is set to the value higher than the reference voltage by the magnitude of the forward voltage of the semiconductor element, an operating voltage of the semiconductor device could be also reduced.

Therefore, according to the present invention, an innovative semiconductor device may be provided, which allows the ripple rejection characteristics to be improved and also the drive voltage to be reduced.

What is claimed is:

1. A series regulator comprising:

a series transistor element connected between an input terminal and an output terminal;

a reference voltage generator circuit for generating a reference voltage;

an error amplifier circuit for generating a signal for operating said series transistor element in response to an output voltage appearing at said output terminal and said reference voltage;

a power supply circuit connected to said input terminal, said reference voltage generator circuit, and said error amplifier circuit for supplying a drive voltage to said reference voltage generator circuit and said error amplifier circuit, said drive voltage being controlled to a value which is lower than a voltage supplied to said input terminal and higher than said reference voltage;

a first transistor operatively arranged in said power supply circuit for supplying said drive voltage to said reference voltage generator circuit and said error amplifier circuit; and a second transistor operatively arranged in said power supply circuit for passing a current therethrough for controlling said first transistor in response to a magnitude of said reference voltage and a magnitude of said drive voltage.

2. A series regulator in accordance with claim 1, wherein said drive voltage is higher than the reference voltage outputted from said reference voltage generator circuit by a magnitude of a forward voltage drop generated on a PN junction of said second transistor.

* * * * *